United States Patent [19]

Andrä et al.

[11] Patent Number: 4,612,747

[45] Date of Patent: Sep. 23, 1986

[54] CONNECTION OF A CAST-IN-PLACE REINFORCED CONCRETE SLAB TO A PREFABRICATED COLUMN

[75] Inventors: Wolfhart Andrä, Stuttgart; Wilhelm Zellner, Leinfelden-Echterdingen; Willi Kunzl; Horst Falkner, both of Böblingen; Bernhard Göhler, Renningen; Hans-Peter Andrä, Stuttgart, all of Fed. Rep. of Germany

[73] Assignee: Deha Baubedarf GmbH & Co. KG, Gross-Gerau, Fed. Rep. of Germany

[21] Appl. No.: 732,837

[22] Filed: May 10, 1985

[30] Foreign Application Priority Data

May 10, 1984 [DE] Fed. Rep. of Germany ..... 3417330

[51] Int. Cl.[4] ..... E04B 1/00

[52] U.S. Cl. ..... 52/250; 52/251; 52/252; 52/260

[58] Field of Search ..... 52/250, 251, 252, 253, 52/260, 600

[56] References Cited

U.S. PATENT DOCUMENTS 2,095,422 10/1937 Stencel ..... 52/252

FOREIGN PATENT DOCUMENTS 2727159 12/1978 Fed. Rep. of Germany .

OTHER PUBLICATIONS

"Bauingenieur", vol. 57, Issue 1, pp. 11–17 in the German language.

*Primary Examiner*—Carl D. Friedman
*Assistant Examiner*—Creighton Smith
*Attorney, Agent, or Firm*—Burns, Doane, Swecker & Mathis

[57] ABSTRACT

A concrete slab is connected to a column passing therethrough. Embedded in the slab are insert parts each having a first recess. The slab also carries a ridge-like reinforcement which includes bars that project through the first recesses and into second recesses carried by the column. The recesses correspond to the cross-sectional shape of the bars and tightly engage same.

13 Claims, 11 Drawing Figures

CONNECTION OF A CAST-IN-PLACE REINFORCED CONCRETE SLAB TO A PREFABRICATED COLUMN

BACKGROUND AND OBJECTS OF THE INVENTION

The invention relates to the connection of a cast-in-place reinforced concrete slab or prestressed concrete slab to a prefabricated central, edge or corner column of reinforced concrete, steel or composite steel that passes through the slab, with the aid of horizontally disposed dowel ledge reinforcements which penetrate the interface between the column and the slab. Construction methods have proven to be economical in building construction using industrial prefabrication, wherein the cast-in-place concrete cover slabs are used in connection with prefabricated supports of reinforced concrete, steel or steel compound, that pass through several stories. Connecting cast-in-place concrete cover slabs to multistoried prefabricated supports is difficult from a construction, economic and design point of view, because the slabs are no longer directly supported on the column and their load cannot be transferred as a stamp-like pressure. It is known from DE-OS No. 27 27 159 to connect a cast-in-place concrete slab monolithically to a column of reinforced concrete passing through the slab with the aid of a horizontally disposed dowel ledge reinforcement which penetrates the interface between the support and the slab. However, if prefabricated continuous supports are used with this construction method, the support concrete in the reinforced concrete column has to be left out locally in those areas which are at the elevation of the cast-in-place concrete slab. In these recesses, only the column reinforcement passes through in the longitudinal direction of the column. In this manner, the cast-in-place concrete slab with the inlaid dowel ledge reinforcement can be reestablished monolithically by the support. The assembly of these supports proves itself to be difficult, however, because the left-out areas can be strongly deformed. It is, therefore, necessary to provide a column for every single massive support segment which is separated by the recesses, until after concreting of the slabs has occurred.

It is further known ("Bauingenieur", Volume 57, Issue 1, Pages 11–17) to provide ready partial columns of steel or steel compound with welded collars of sectional steel on which the slab is supported as a "corner-hole-supported slab". For safety against punching, a dowel ledge reinforcement according to DE-OS No. 27 27 159 can be disposed in the slab. However, the welded collars which are visible from below disturb the architectural design of the space as well as posing a fire hazard, and are especially costly to produce because of the required special care. Construction difficulties in the connection of cast-in-place concrete slabs to prefabricated columns are also created, in particular, if the slabs are prestressed. The tendons must substantially pass over the support in order for the radial forces to be transferred directly to the column due to rounding-off of the passage of the tendons. Multistoried prefabricated columns are recessed in the penetration zone with the prestressed slab which causes the above-mentioned difficulties of assembly.

Underlying the invention is the object of connecting cast-in-place concrete slabs to columns passing through several stories with high load capacity and without connecting elements outside of the penetration zone of cast-in-place concrete slab and prefabricated column.

SUMMARY OF PREFERRED EMBODIMENTS OF THE INVENTION

The object is solved according to the invention in a connection of the designated type wherein the interface is substantially planar. The ledges of the dowel ledge reinforcement are tightly embraced directly at the interface by horseshoe or eye-shaped steel insert parts shaped according to the ledge cross-section and embedded in the slab, or in case a steel concrete support is used, also in the steel concrete support. When a steel or composite steel column is used, the ledges of the dowel ledge reinforcement are tightly embraced by openings formed directly in the steel support mantle shaped correspondingly to the ledge cross-section.

In the event that the ledge is formed by round steel, the corresponding openings can be formed simply by bores in the insert parts or in the steel mantile of the support, respectively. Until the introduction of the ledge ends in these openings, in particular, during the concreting of the column, these openings can be kept free, e.g., by using plastic plugs. In the case of flat steel ledges, slots or longholes are provided in the steel support and in the insert part which can be stamped, for example. No special skills are required for these measures, nor for the setting up of the dowel ledge reinforcement, so that a cost-efficient production of the connection is ensured.

The load capacity is increased by the insert parts during small deformation, because the ledge elements are now subjected to shear without bending. Correspondingly, large cover loads can be transferred to the support substantially deformation-free. The deflection of the resulting forces into the support is carried out by attachment means which rigidly anchor the steel insert part in the surrounding concrete and thus make possible the substantially deformation-free shear effect. Attachment means with slip-free anchoring, e.g., cone head dowels, are especially effective. This interconnection between the cast-in-place cover slab and the support not only allows the introduction of vertical forces but also the introduction of horizontal forces acting at the interface between the cast-in-place concrete slab and the support, or in the case of at least two dowel ledge reinforcements per support side, disposed beside or on top of each other, also the introduction of bending moments over a couple, respectively. In the case of edge or corner columns, the column sides disposed perpendicular to the slab edge can be interconnected with the slab in such a way, that as a further advantage according to the invention, the lower field reinforcement does not have to run into the support and be anchored therein to receive the perpendicular force thrust.

The connection construction according to the invention lies between cover and support within the penetration zone between cover and support, so that special measures for corrosion and fire protection are not necessary. The high load capacity of the slab in the zone near the support is ensured by the dowel ledge reinforcement that is also used for protection against punching. In particular, radial forces from prestressing can be received in the slab region which is provided with a dowel ledge reinforcement, and deflected through the connection construction in the prefabricated support. The tendons no longer need to be guided over the support, but can be arranged beside the support with a rounded-off configuration. The steel insert parts represent a frame and reinforcement of the slab opening at the support rim.

BRIEF DESCRIPTION OF THE DRAWING

Embodiments of the invention are represented in the drawing and are described in more detail in the following detailed description in conjunction with the accompanying drawings in which.

DETAILED DESCRIPTION OF A PREFERRED EMBODIMENT OF THE INVENTION

Figure 1A:
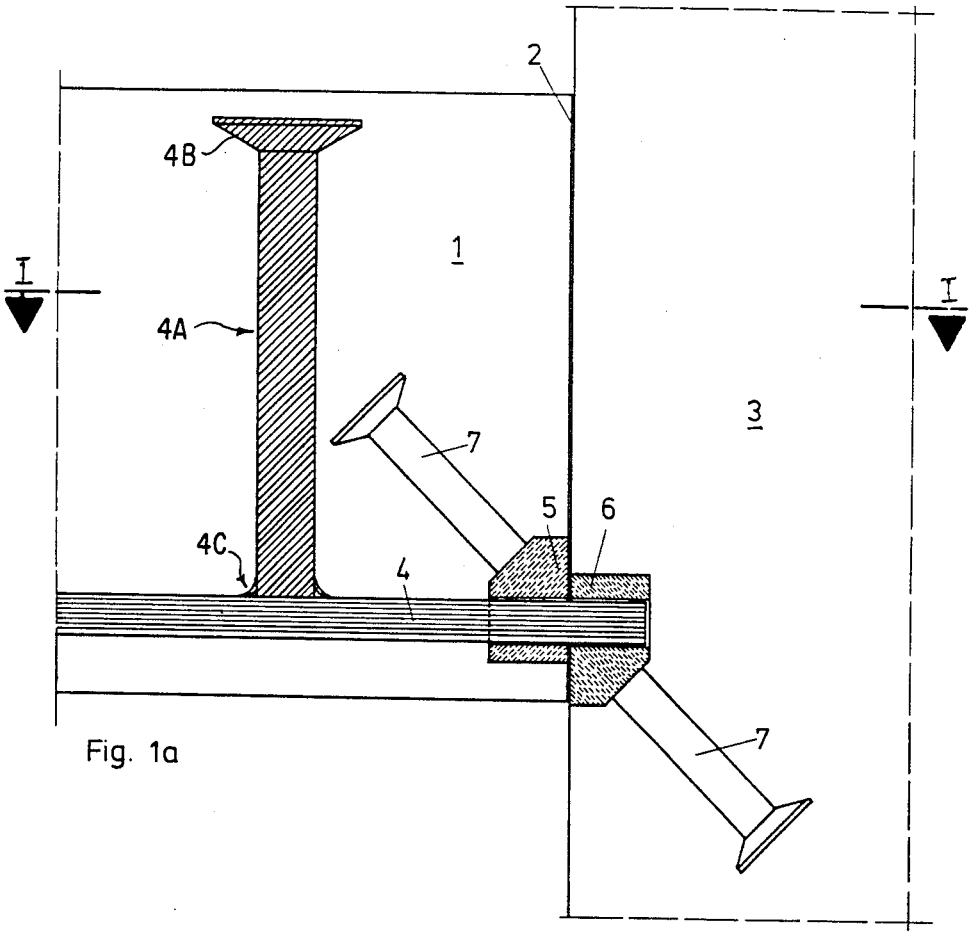
FIG. 1*a* is a fragmentary sectional view taken through a connection of a slab to a column in accodance with the present invention.
Figure 1B:
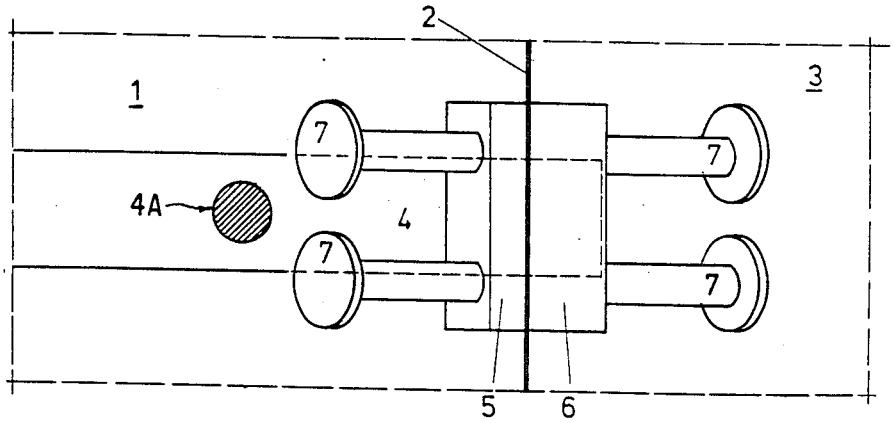
FIG. 1*b* is a top view of the connection depicted in FIG. 1*a* in the direction of the arrows I—I.

FIGS. 1*a* and 1*b* show a cross-sectional and top view of the connection construction at a reinforced concrete column. A slab 1 faces a prefabricated steel concrete support 3 along an interface or joint 2. A slab insert part 5 and a support insert part 6 are anchored by welded attachment means 7 in the concrete of slab 1 or in the concrete of the prefabricated reinforced concrete column 3, respectively. The slab 1 carries dowel ledge reinforcement which includes flat steel ledges or bars 4 received in aligned recesses in the slab insert part 5 and the support insert part 6, which recesses have a shape corresponding to the ledge cross-section. Vertical reinforcing studs 4A have enlarged upper ends 4B and lower ends which are welded at 4B to the bars and thus become embedded in the slab.

Figure 2A:
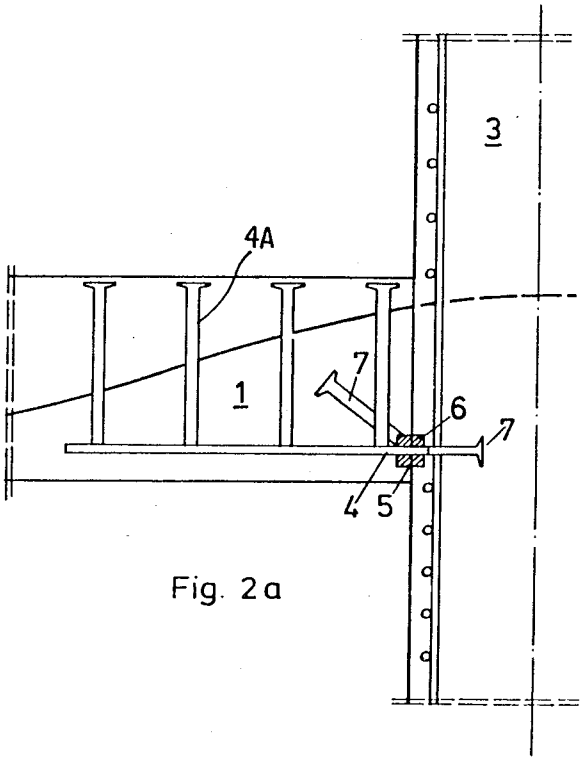
FIGS. 2*a*, 2*b* are each vertical sections through the connection depicting, in FIG. 2*a*, a column formed of steel concrete and, in FIG. 2*b*, a column formed of steel.
Figure 2B:
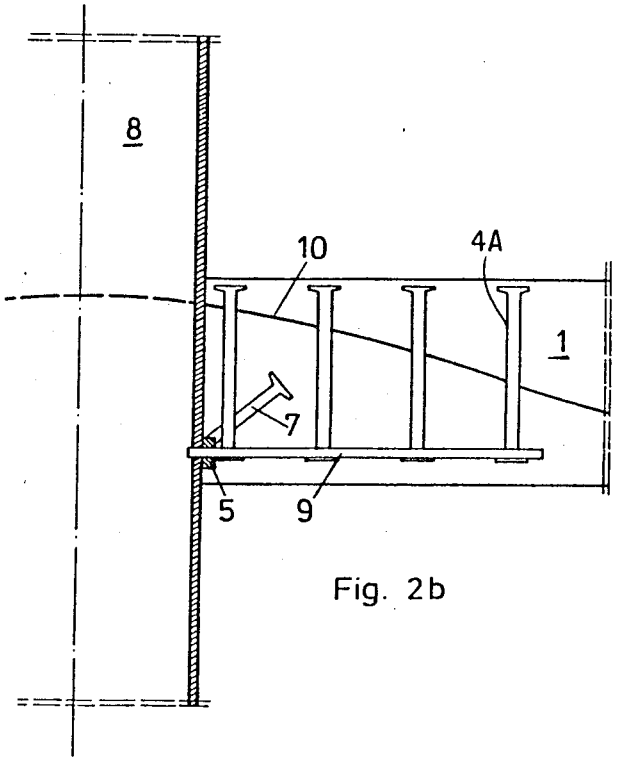

FIG. 2 shows the connection construction in vertical cross-section. In FIG. 2*a*, the connection of a slab 1 to a reinforced concrete column 3 is shown, whereas the connection of a slab 1 to a steel column 8 is shown in FIG. 2*b*. For simplification, it is recommended to use in the case of the latter, round steel ledges 9 in the dowel ledge reinforcement. Those round ledges are inserted in corresponding openings in the steel support 8.

Tendons 10 are shown which are disposed in the slab outside of the support and deliver their radial forces to the dowel ledge reinforcement.

Figure 3:
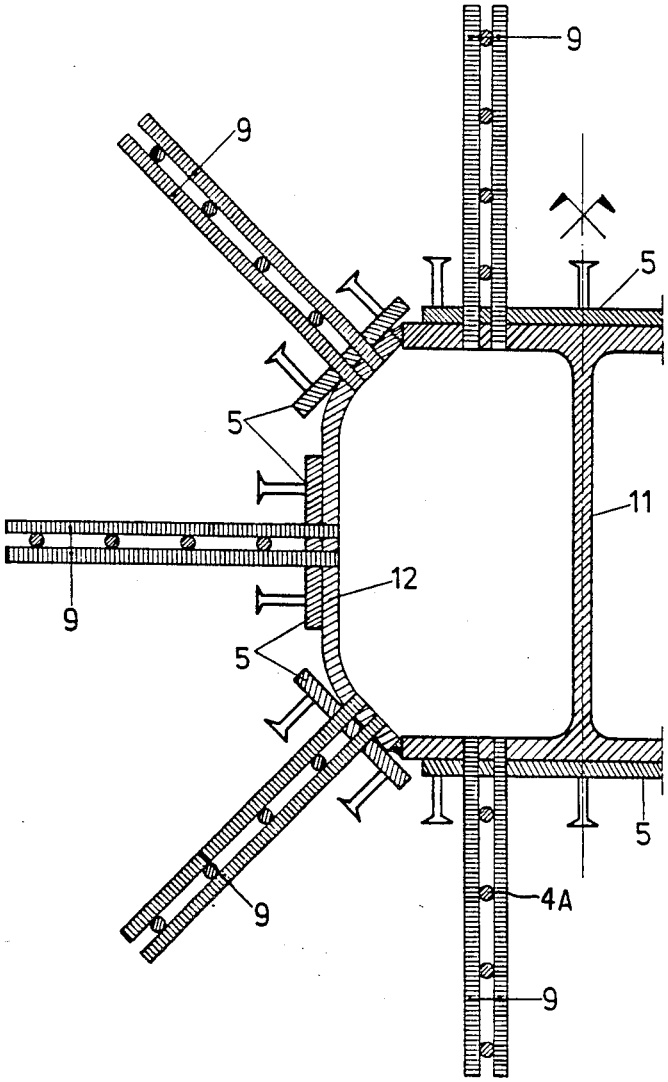
FIG. 3 is a sectional view taken through a modified form of the column.

In FIG. 3, an I-profile column 11 is shown to which are welded sheets 12 in the vicinity of the ledges to form a box-like cross-section into which the round steel ledges 9 are inserted, the ledges being arranged in a fan-like pattern. The slab support of the round steel ledges 9 is effected by the slab insert parts 5.

Figure 4:
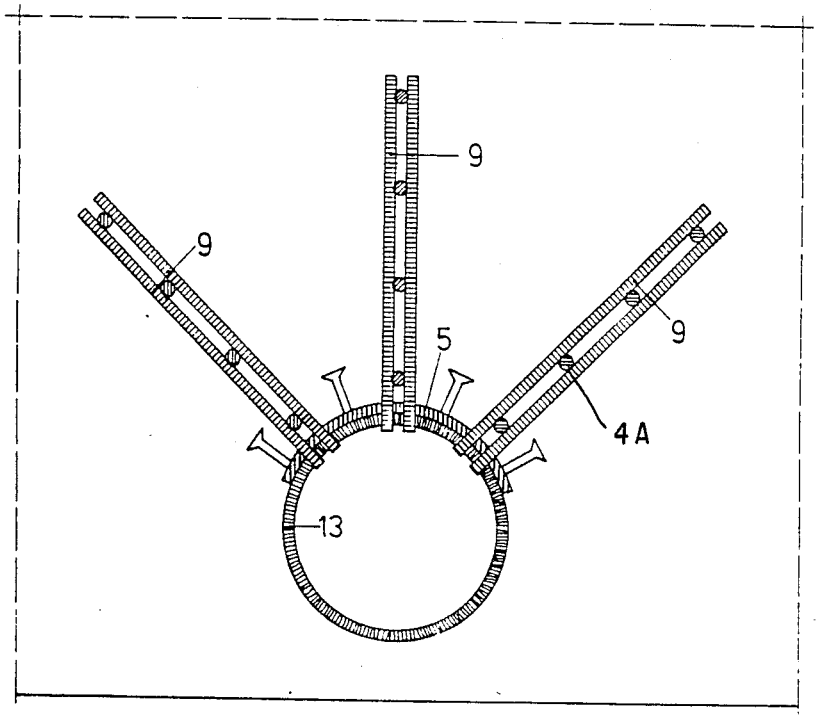
FIG. 4 is a sectional view taken through yet another form of the column.

The connection of a slab with round steel ledges 9 and slab insert parts 5 to a steel tube support 13 is shown in FIG. 4. The slab insert part 5 is shaped to correspond to the circular mantle surface of the steel tube 3.

Figure 5A:
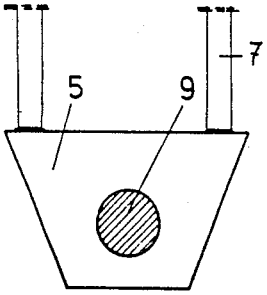
FIGS. 5*a* through 5*e* depict, respectively, various preferred shapes of the slab insert part, and the dowel ledge.
Figure 5C:
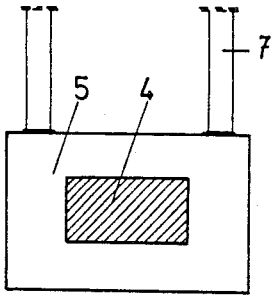
Figure 5B:
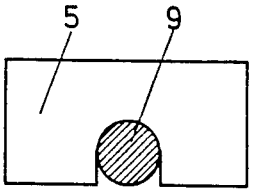
Figure 5D:
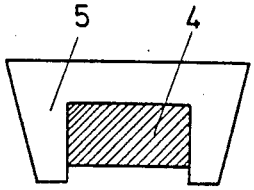
Figure 5E:
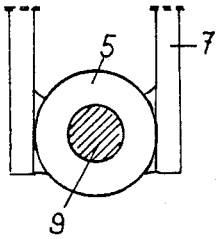

FIGS. 5*a*–5*e* show other preferred embodiments of the slab insert part 5. According to FIGS. 5*a*, 5*c* and 5*e*, the steel ledge (flat or round) is embraced by the inserts which are shaped as eyelets. In FIGS. 5*b* and 5*d*, horseshoe-shaped slab insert parts are shown. The insert parts 5 in FIGS. 5*a*, 5*c* and 5*e* are anchored into the concrete by welded attachment means 7 which can comprise setbolt dowels or anchor loops, for example.

The insert parts 5, 6 can be interconnected by welding at corners of the support.

The insert parts 5, 6 can be connected to the dowel ledge reinforcement, e.g., by screws, welding or stamping.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. In an assembly of a cast-in-place concrete slab of reinforced concrete or prestressed concrete to a column passing vertically through the slab, said slab facing said column along a substantially planar vertical interface, steel inserts embedded in said slab at said interface, each insert including a first generally horizontal recess facing said interface in alignment with a second generally horizontal recess in said column, a plurality of generally horizontal steel reinforcing bars embedded in said slab, a plurality of generally vertical reinforcing studs embedded in said slab and including lower ends connected to said bars, said bars spaced apart horizontally in a fan-like pattern converging toward said column, said bars passing through and beyond said first recess and into said second recess, said first and second recesses shaped correspondingly to the cross-sectional shape of said bars and tightly embracing said bars.

2. An assembly according to claim 1, wherein said column is formed of reinforced concrete, additional steel inserts anchored in said support and carrying said second recesses.

3. An assembly according to claim 1, wherein said column is formed of steel or a composite steel, said second recesses being formed directly in said support.

4. An assembly according to claim 1, wherein said inserts are eye-shaped.

5. An assembly according to claim 1, wherein said inserts are horseshoe-shaped.

6. An assembly according to claim 1, wherein at least the portions of said bars passing through said interface are hardened.

7. An assembly according to claim 1, wherein at least the portions of said bars passing through said interface comprise high strength steel.

8. An assembly according to claim 2, wherein said inserts are welded together at corners of said column.

9. An assembly according to claim 1, wherein said column comprises an I-beam having sheets welded across flanges of the beam, said sheet carrying said second recesses.

10. An assembly according to claim 1 including at least one embedded reinforcing dowel welded to each said insert.

11. An assembly according to claim 1, wherein said column has a generally curvalinear periphery as viewed in plan, said inserts being curved complementarily to said periphery so as to lie substantially flush thereagainst.

12. An assembly according to claim 1, wherein said bars are situated at an upper portion of said slab.

13. An assembly according to claim 1, wherein said inserts are connected to said bars.

* * * * *